United States Patent [19]

Weise

[11] 4,340,116

[45] Jul. 20, 1982

[54] SLIP DEPLOYMENT MECHANISM

[75] Inventor: Stanley A. Weise, Dallas, Tex.

[73] Assignee: Dresser Industries, Inc., Dallas, Tex.

[21] Appl. No.: 187,000

[22] Filed: Sep. 15, 1980

[51] Int. Cl.[3] ..... E21B 23/00

[52] U.S. Cl. ..... 166/215; 166/216; 166/217

[58] Field of Search ..... 166/215, 216, 217, 209-211, 166/137, 139

[56] References Cited

U.S. PATENT DOCUMENTS

| | | | |
|---|---|---|---|
| 2,228,503 | 1/1941 | Boyd et al. | 166/216 X |
| 2,290,142 | 7/1942 | Burt | 166/137 X |
| 2,323,085 | 6/1943 | Davis | 166/137 X |
| 2,693,859 | 11/1954 | Wright | 166/137 X |
| 2,929,453 | 3/1960 | Conrad | 166/217 X |
| 3,232,347 | 2/1966 | Thrane | 166/136 |

*Primary Examiner*—Stephen J. Novosad

*Assistant Examiner*—Joseph Falk

*Attorney, Agent, or Firm*—J. N. Hazelwood; W. R. Peoples

[57] ABSTRACT

A slip deployment mechanism for use in conjunction with a packer in a tubing string includes a cylindrical retainer telescoped over the upper ends of a plurality of slip segments and interfitting means on the segments and a mandrel coact with the retainer to keep the slips locked in place. A longitudinally acting spring reacting against a lateral reaction surface on the mandrel urges against the slip segments to advance them into an initially set position between an expander head of the packer and the interior wall of the casing when the retainer is moved from a locked position into a release position to free the slip segments. A stop acting between the mandrel and the retainer prevents the lower end of the retainer from binding against the slip segments in service use.

10 Claims, 3 Drawing Figures

SLIP DEPLOYMENT MECHANISM

TECHNICAL FIELD

This invention relates to a mechanism for supporting and deploying slips on a well tool such as a packer and specifically is concerned with a slip deployment mechanism which functions to positively hold the slips in a retracted position when running the tool into the well and which may be released thereafter by manipulation of the tubing string to advance the slips for setting against casing in the well.

BACKGROUND ART

When placing a slip-supported tool like a packer in a well, it is desirable to have the slip segments positively constrained in a retracted position to keep from being peeled off the tool when passing through the fluid in the well and to help avoid premature setting of the tool in the well. One prior arrangement of this general type is disclosed in U.S. Pat. No. 3,232,347 and in that arrangement, the lower end of a setting sleeve fits over the upper ends of the slip segments to keep the latter from moving radially outward as the arrangement is being lowered into a well. After reaching a specified well location, the tubing string carrying the arrangement is manipulated through a number of steps in a predetermined sequence involving raising, rotating and lowering the string in order to move several intricate parts of the arrangement in freeing the slips segments for use. Once free from the constraint of the sleeve, spring bands acting radially outward urge the segments against the interior wall of the well casing.

DISCLOSURE OF INVENTION

The present invention provides an improved slip deployment mechanism of the foregoing general character but which is of a substantially simpler, more reliable construction and which, in service use, requires less manipultion of the tubing string in order to set the slips. Thus, it will be appreciated that the task of setting the slips is simplified, made more reliable and may be accomplished more expeditiously than theretofore. More particularly, the present slip deployment mechanism is uniquely constructed so as to enable the slips to be set initially by merely rotating the tubing string after being lowered into the appropriate well location and without having to also lift the string. Advantageously, a longitudinally acting spring in the mechanism serves to urge the slips into engagement both with an expander head of the well tool and the interior wall of the casing.

The invention also resides in the novel manner of supporting the slips on the well tool and in the provision of a unique slip follower and the novel manner in which the follower is mounted in the mechanism so as to engage the slip segments under the urging of the spring for inititally setting the slips in the casing.

These and other objects and advantages of the present invention will become more apparent from the following description of the best mode for carrying out the invention when taken in conjunction with the accompanying drawings.

BEST MODE OF CARRYING OUT THE INVENTION

In one form of prior slip deployment mechanism, such as is shown in U.S. Pat. No. 3,232,247 for a well tool a cylindrical slip retainer is telescoped over the upper end portions of a series of angularly spaced slip segments and thus confines the segments in place above a frusto-conical expander head of the tool to keep the segments from being inadvertently deployed as the well tool is positioned within the casing of a well. Once the tool is positioned as desired in the well, a series of manipulations of the tubing string carrying the tool causes the slips to wedge against the expander head and bite into the interior wall of the casing thereby setting the slips to support the tool in the well. In manipulating the tubing string, the lower end portion of the slip retainer is raised above the slip segments, freeing the latter to be urged into engagement with the interior wall of the casing by a spring located within the mechanism.

Figure 2:
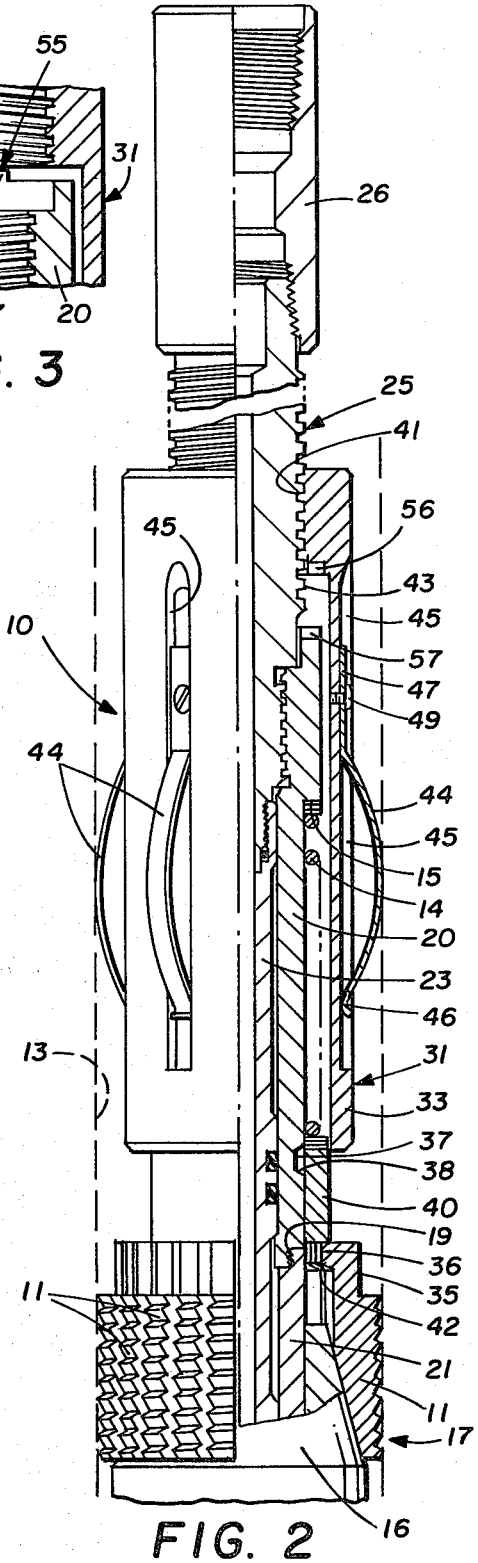
FIG. 2 is a view similar to FIG. 1 but showing parts of the mechanism in moved positions.

The present invention contemplates an improved slip deployment mechanism 10 of the foregoing general character which is of a much simpler overall construction and which, in service use, requires less manipulation of the tubing string in order to set slip segments 11 in a well casing 13 (shown in phantom only FIG. 2). For these purposes, fewer parts are utilized in the construction of the mechanism and, in particular, the mechanism is fashioned so a spring 14 acts between the slip segments and a lateral reaction surface 15 to deploy the slips. By virtue of this unique construction, the various parts comprising the mechanism cooperate in a novel manner whereby the slip segments are set initially in a wedged position against both the interior wall of the casing and an expander head 16 of a well tool 17 under the urging of the spring by simply rotating the tubing string once the tool is located in its desired position in the well. Advantageously, this eliminates the need otherwise for lifting the tubing string in order to wedge the expander head and slip segments initially together.

In the present instance, the exemplary slip deployment mechanism 10 is illustrated as incorporated in a packer. This form of well tool 17 is, of course, well known and thus most details of the packer construction have been omitted from this description as not being necessarily significant to the invention. Shown, however, is the connection of the slip deployment mechanism to the packer 17 and this is made through a threaded coupling 19 between mandrels 20 and 21 in the mechanism and the packer, respectively. The packer mandrel 21 extends in an axial direction through the expander head 16 which is of a frusto-conical shape, and mates with the mechanism mandrel 20. Herein, the packer and slip mechanism mandrels are shown as separate parts for ease in assembling the packer but other variations of the slip deployment mechanism and packer could be made with these two mandrels formed instead as a single piece. Telescoped into both the mandrels is a stinger 23 which carries the usual annular seals 24 for sealing engagement against the interior of the mandrel. An adapter 25 is connected between the stinger and an upper connector 26 and serves to secure the stinger to the lower end of the tubing string.

When running the tubing string into the well to set the packer 17 at a particular position, the slip segments 11 are carried on the mechanism mandrel 20, but are angularly disposed relative to each other above the expander head 16. Each of the slip segments includes an outer surface which is provided with the usual teeth 27 for embedding in the interior surface of the well casing 13 to support the packer in the well. An inner surface 29 of each segment is angled with respect to the outer surface for camming engagement with the exterior surface 30 of the expander head so that longitudinal movement of the slip segments on the mechanism mandrel into engagement with the expander head wedges the segments radially outward for the teeth to embed in the casing.

To keep the slips segments 11 from being peeled off the tool 17 as the tubing string is lowered through the fluid in the well when positioning the packer 17 in the casing 13, a tubular slip retainer 31 is telescoped over the mechanism mandrel 20 into a locked position with a lower end portion 33 of the retainer overlapping an upper end portion 34 of each of the slips segments to fit within a recess 35 in the upper end portion of each segment. In this way, the slip segments normally are constrained against movement radially outward. Downward movement of the slip segments relative to the retainer is prevented by means interfitting between the mechanism mandrel and the slip segments. Herein, such means is in the form of a boss 36 formed integrally with the upper end of each segment and extending radially inward therefrom to fit within an annular groove 37 formed in the mechanism mandrel 20.

Deployment of the slips 11 is accomplished by raising the slip retainer 31 relative to the mechanism mandrel 20 from its locked position into a release position to enable the spring 14 to push the slip segments downwardly out of the annular groove 37. In its release position the lower end portion 33 of the retainer is level with or spaced slightly upwardly from the upper ends of the segments and, thus, the latter are free to be cammed radially outward under the urging of the spring. More particularly, the spring 14 is of a coilded configuration and is mounted concentric with the mechanism mandrel. An upper end 39 of the spring urges against the reaction surface 15 which herein is in the form of an annular shoulder extending in a generally lateral or radial direction outwardly from the outer surface of the mechanism mandrel. The lower end of the spring urges against a cylindrical follower 40 which in turn abuts the upper ends of all of the slip segments 11. And the lower edge 38 of the groove 37 is slanted downwardly and radially outward as is the under surface 42 on each boss. Accordingly, when the retainer 31 is raised, the follower 40 urged by the spring 14 pushes the segments downwardly out of the groove 37 with each of the segments jogging radially outward a distance equal to the radial thickness of its boss 36. Thereafter, the segments slide downwardly until the inner walls 29 of the segments wedge against the exterior surface 30 of the frusto-conically shaped expander head 16 whereupon the segments are again forced radially outward to wedge between the head and the interior wall of the casing 13.

Advantageously, raising of the slip retainer 31 relative to the mechanism mandrel 20 is achieved merely by rotation of the tubing string to which the mechanism is connected. For this purpose, the slip retainer includes an internally threaded upper end section 41 mated with an externally threaded section 43 on the stinger adapter 25 and a series of angularly-spaced drag springs 44 are attached to the outer surface of the retainer. Herein, there are eight of the drag springs 44 mounted within a like number of axially extending grooves 45 opening outwardly from the retainer. Each of the springs is a leaf-spring having one free end 46 and an opposite end 47 secured to the retainer within one of the grooves such as by means of a screw 49. The two threaded sections 41 and 43 between the adapter and the retainer, are right-hand threaded and, when the mechanism is located in the well, the springs 44 engage the interior wall of the casing 13 so the retainer resists against rotation. Accordingly, when the tubing string is rotated in a clockwise (right-hand) direction, the adapter turns with the tubing but the retainer does not rotate. Because of this, the resulting relative rotation causes the retainer to ride upwardly on the adapter thereby lifting the lower end portion 33 from the recessess 35 in the slip segments 11 so as to free the segments.

Figure 1:
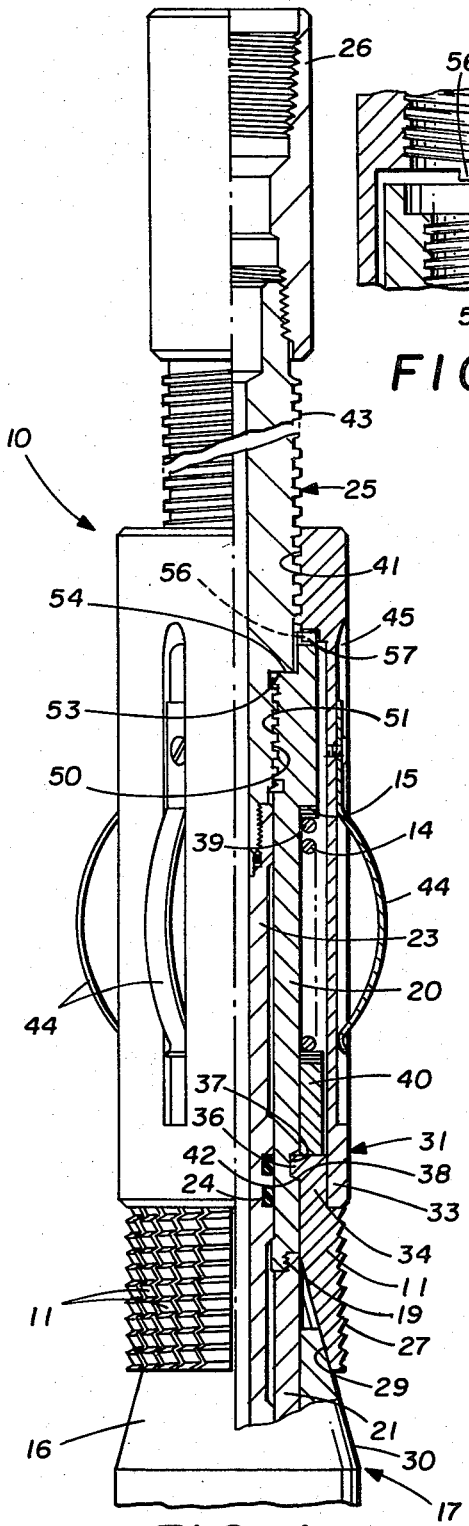
FIG. 1 is a combined elevational and cross-sectional view of a slip deployment mechanism embodying the novel features of the present invention.

Separation of the adapter 25, the slip retainer 31 and the stinger 23 from the mechanism mandrel 20 and the pakcer 17 as set within the well is possible with the exemplary mechanism when it is desired to remove an upper section of the tubing string from the well casing 13. As shown in FIG. 1, the adapter includes a second, externally-threaded lower section 50 mated with an internally threaded section 51 in the upper end portion of the mechanism mandrel 20. These threaded sections 50 and 51 are left-hand threaded and of a pitch less than that of the threaded sections 41 and 43 so that rotation of the tubing string in a clockwise direction (right hand) with the mechanism mandrel 20 held against rotation causes these two left-hand threaded sections to separate thereby freeing the adapter, the stinger and the retainer to allow the tubing string above the packer to be removed from the well with the packer being left in place. While not shown in detail it is to be noted that a radial pin connection (not shown) exists between the expander head 30 and the packer mandrel 21 so as to prevent relative rotation between these two parts. Once the slip segments 11 are anchored in the casing, the radial pin connection in turn, effectively prevents rotation of the mechanism mandrel 20 within the casing.

Reassembly of the exemplary mechanism 10 may be accomplished downhole by simply lowering the tubing string carrying the stinger 23 until the latter telescopes into the mechanism mandrel 20. Rotation of the string thereafter in a counterclockwise (left hand) direction will cause the threaded sections 50 and 51 to remate with the downward extent of movement of the stinger 23 into the mechanism mandrel being limited by abutting engagement of an annular shoulder 53 on the adapter with a corresponding shoulder 54 on the upper end of the mechanism mandrel. As shown in the drawings, the adapter shoulder 53 is located axially between the right and left hand threaded sections 41 and 50.

Figure 3:
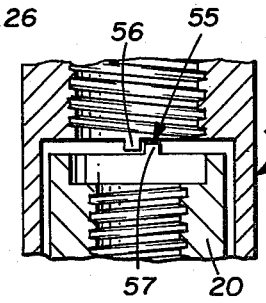
FIG. 3 is an enlarged fragmentary, cross-sectional view of a portion of the mechanism taken as looking to the right in FIG. 1, but with parts of the mechanism removed for clarity of illustration.

In initially assembling the exemplary mechanism 10 for use in the well, a rotational stop means 55 (see FIGS. 1 and 3) is provided between the retainer 31 and the mechanism mandrel 20 to keep the lower end 33 of the retainer from binding against the slips. Herein, the stop comprises tabs 56 and 57 formed on the retainer and the upper end of the mechanism mandrel 20, respectively. The tabs 56 and 57 project axially toward each other with their axial heights being approximately equal to the pitch of the threads in the mating sections 41 and 43 of the retainer and adapter. The mechanism mandrel tab 57 is to the right (clockwise) of the retainer tab 56 as viewed in FIG. 3 so that rotation of the tubing string in a clockwise direction moves the mandrel tab away from engagement with the retainer tab. Upon completion of one turn with the tubing string from a position with the tabs 56 and 57 abutting each other, the vertical distance separating the two tabs is such as to place them so as to avoid engagement with each other with successive turns. But, when the tabs are in abutting engagement with each other, the lower end 33 of the retainer is spaced slightly upwardly from the ends of the slip segment recesses 35 so as to avoid binding of the segments in the mechanism.

In view of the foregoing, it is seen that the slip deployment mechanism 10 of the present invention is easier to use and is of a simpler and more reliable construction than prior arrangements by virtue of utilizing the boss 36 and groove 37 arrangement in conjunction with the retainer 31 to hold the slips 11 in place on the mechanism mandrel 20 and by advantageously employing the axially directed spring 14 to initially set the slip segments 11.

The embodiments of the invention in which an exclusive property or privilege is claimed are defined as follows:

1. A slip deployment mechanism for use in a tubing string in conjunction with a well tool having a frustoconical expander head for setting a plurality of slips segments against the interior wall of a well casing, said mechanism comprising means for connecting to the tubing string, a spring reaction surface extending laterally relative the longitudinal axis of said mechanism and connected with said connecting means, said slip segments being releasably secured to said connecting means and spaced longitudinally from said reaction surface, a slip retainer mounted on said connecting means for longitudinal movement relative to said reaction surface between a locked position in confining engagement with said slips segments and a release position freeing said slips segments to be set against the interior wall of the casing, interfitting means on said slips segments and said connecting means for coacting with said retainer to secure said slips segments in a locked position relative to said reaction surface when said retainer is in its locked position, and a longitudinally-acting spring mounted between said reaction surface and said slip segments and urging said segments toward an initially set position in engagement with both said expander head and the interior wall of the casing when said slip retainer is moved into its release position.

2. A slip deployment mechanism as defined by claim 1 wherein said connecting means includes a stinger adapter having a first threaded section, said slip retainer being connected threadably to said adapter at said first threaded section.

3. A slip deployment mechanism as defined by claim 1 wherein said spring comprises coil spring mounted concentrically between said connecting means and said retainer.

4. A slip deployment mechanism as defined by claim 3 wherein said interfitting means comprises a boss on each of said slips and an annular groove formed in said connecting means, said groove and said bosses having abutting cam surfaces for wedging said slips radially outward under the urging of said spring when said retainer is moved into its release position.

5. A slip deployment mechanism as defined by claim 3 wherein said slip retainer comprises a tubular member with one end threadably mounted on said connecting means and an opposite end portion telescoped over said slips segments when said retainer is in its locked position and coacting with said interfitting means to secure said slips segments in their locked positions, said anchor cage having a plurality of longitudinally extending drag springs mounted thereon for sliding engagement with the interior wall of said casing in a longitudinal direction and providing resistance to rotation of said retainer with said connecting means so the retainer moves longitudinally, within the well when said connecting means is rotated relative to retainer means.

6. A slip deployment mechanism as defined by claim 5 including a cylindrical follower mounted between said spring and said slips segments.

7. A slip deployment mechanism as defined by claim 6 including a tubular mandrel secured to said connecting means and a tubular stinger secured to said connecting means and telescoped into said mandrel a left-hand threaded section securing said mandrel to said connecting means, stop means acting between said mandrel and said tubular member to limit the extent to which said opposite end portion of said tubular member may be telescoped over said slip segments.

8. A slip deployment mechanism as defined by claim 7 wherein said stop means comprises first and second tabs on said tubular member and said mandrel respectively, said tabs each having a length in the longitudinal direction approximately equal to the pitch of the thread in said threaded end section of said mandrel.

9. A slip deployment mechanism for use in a tubing string in conjunction with a well tool having a frustoconical expander head for setting a plurality of slips segments against the interior wall of a well casing, said mechanism comprising a tubular adapter for connection to the tubing string and having first and second external threaded sections of opposite hand relative to each other, said second threaded section being spaced radially inward and axially downward from said first threaded section, a slip retainer having an internally threaded upper end section mated with said first threaded section of said adapter and an opposite end portion telescoped over said slips segments and normally confining said segments against movement radially outward thereof, a plurality of angularly-spaced drag springs secured to said retainer for engagement with the interior wall of said casing to hold said retainer against rotation within said casing, a tubular mandrel telescoped into said slip retainer and spaced radially inward therefrom, said mandrel having an internally threaded upper end portion mated with said second threaded section of said adapter and an annular external shoulder formed intermediate the ends thereof, an annular groove formed in said mandrel beneath said coil spring, said plurality of slip segments being normally carried by said mandrel with each slip segment having a boss formed thereon and protruding into said groove to support said segments upwardly on said mandrel, a coil spring telescoped into the space between said mandrel and said retainer with one end thereof abutting said shoulder, stop means on said retainer and said mandrel positioned for abutting engagement with each other to limit the extent to which said retainer and said mandrel may be telescoped together, and a slip follower having an upper end engaged by the lower end of said coil spring a lower end urged into engagement with the upper ends of at least one of said slips, said retainer being movable upwardly relative to said mandrel upon rotation of said adapter to lift said opposite end portion from confining engagement with said slip segments whereby said coil spring urges said follower to dislodge said bosses from said groove and shift said segments downwardly against said expander head and outwardly against the interior wall of said casing to initially set said slips segments in the well.

10. A slip deployment mechanism for use in a tubing string in conjunction with a well tool having a frustoconical expander head for setting a plurality of slips segments against the interior wall of a well casing, said mechanism comprising a tubular adapter for connection to the tubing string and having first and second external threaded sections of opposite rotational hand relative to each other, said second threaded section being spaced radially inward and axially downward from said first threaded section, a slip retainer having an internally threaded upper section mated with said first threaded section of said adapter and an end portion telescoped over said slips segments and normally confining said segments against movement radially outward thereof, a plurality of angularly-spaced drag springs secured to said retainer for engagement with the interior wall of said casing to hold said retainer against rotation within said casing, a tubular mandrel telescoped into said slip retainer and spaced radially inward therefrom, said mandrel having an internally threaded upper end portion mated with said second threaded section of said adapter and an annular external shoulder formed intermedaite the ends thereof, an annular groove formed in said mandrel beneath said coil spring, said plurality of slips segments being normally carried by said mandrel with each slip segment having a boss formed thereon and protruding into said groove to support said segments upwardly on said mandrel, and a coil spring telescoped into the space between said mandrel and said retainer with one end abutting said shoulder and the opposite end urging downwardly against said slip segments, said retainer being movable upwardly relative to said mandrel upon rotation of adapter to lift said opposite end portion from confining engagement with said slips segments whereby said coil spring urges said follower to dislodge said bosses from said groove and shift said segments downwardly against said expander head and outwardly against the interior wall of said casing to initially set said slips segments in the well.

* * * * *